US009103643B2

(12) United States Patent
Lee

(10) Patent No.: US 9,103,643 B2
(45) Date of Patent: Aug. 11, 2015

(54) FUSE HAVING SELF-DESTRUCT FUNCTION AND IMPACT RESISTANCE

(71) Applicant: SEJU ENGINEERING CO., LTD, Daejeon (KR)

(72) Inventor: Won-Bae Lee, Daejeon (KR)

(73) Assignee: SEJU ENGINEERING CO., LTD., Daejeon (KR)

( * ) Notice: Subject to any disclaimer, the term of this patent is extended or adjusted under 35 U.S.C. 154(b) by 0 days.

(21) Appl. No.: 14/357,111

(22) PCT Filed: Nov. 15, 2012

(86) PCT No.: PCT/KR2012/009675
§ 371 (c)(1),
(2) Date: May 8, 2014

(87) PCT Pub. No.: WO2014/058097
PCT Pub. Date: Apr. 17, 2014

(65) Prior Publication Data

US 2014/0305325 A1 Oct. 16, 2014

(30) Foreign Application Priority Data

Oct. 9, 2012 (KR) ..... 10-2012-0111943

(51) Int. Cl.

| | |
|---|---|
| ***F42B 3/12*** | (2006.01) |
| ***F42C 11/00*** | (2006.01) |
| ***F42C 19/12*** | (2006.01) |
| ***F42C 1/00*** | (2006.01) ***F42C 1/02*** |
| (2006.01) | ***F42C 9/16*** |
| (2006.01) | |

(52) U.S. Cl.
CPC . *F42C 11/00* (2013.01); *F42C 1/00* (2013.01); *F42C 1/02* (2013.01); *F42C 9/16* (2013.01); *F42C 19/12* (2013.01)

(58) Field of Classification Search
CPC ..... F42D 1/05; F42D 1/055; F42D 1/04; F42C 11/00; F42C 11/06; F42C 15/184
USPC ..... 102/202.5, 202.6, 204, 221, 266, 268, 102/272, 275
See application file for complete search history.

(56) References Cited

U.S. PATENT DOCUMENTS

| | | | | |
|---|---|---|---|---|
| 2,999,910 A * | 9/1961 | Cooley | ..... | 200/52 R |
| 3,815,505 A * | 6/1974 | Roh et al. | ..... | 102/210 |
| 5,386,774 A | 2/1995 | Yamamoto et al. | | |
| 6,302,025 B1 | 10/2001 | Adimari et al. | | |

FOREIGN PATENT DOCUMENTS

| | | |
|---|---|---|
| KR | 10-0416004 B1 | 11/2005 |
| KR | 10-2011-0070122 A | 6/2011 |
| KR | 10-1078153 B1 | 10/2011 |

* cited by examiner

*Primary Examiner* — Samir Abdosh
(74) *Attorney, Agent, or Firm* — Rabin & Berdo P.C.

(57) ABSTRACT

There is provided an impact resistance self-destruct fuse installed in a shell and functioning to ignite explosion of the unexploded shell occurred in the case that a shell falls on the inclined ground or barriers but fails to be exploded by a mechanical fuse, by the configuration including a fuse slide having grooves formed on the top and the bottom at one side of the fuse slide so as to be easily breakable by absorbing the impact occurred when the shell falls and bounces, a battery displaced inside the portion of the fuse slide which is separated off by the grooves, and a battery hit needle located along the line where the battery is located in order to hit the battery, and a detonator exploded by the electric energy from the battery or exploding the impact resistance self-destruct fuse by sensing the short of the battery in circuits.

2 Claims, 3 Drawing Sheets

FUSE HAVING SELF-DESTRUCT FUNCTION AND IMPACT RESISTANCE

TECHNICAL FIELD

The present invention relates to a fuse having self-destruct function and impact resistance, and more particularly, to an impact resistance self-destruct fuse provided in a shell and having grooves formed at one side of the fuse slide of the fuse, and configured to prevent the entire fuse structure being short when the shell falls and bounces, and to sense the short of a battery and control a self-destruct directives by a control part.

BACKGROUND ART

Generally, a shell fired by artillery or multiple rocket launcher on the ground is filled with high explosive powder inside its body, and has a penetrator disposed below in order to penetrate armored cars or tanks and is used in civilians killing or armored penetrating.

A fuse is installed at the top or bottom of the shell as means to ignite explosion of the high explosive powder. The fuse includes the kinds of a mechanical fuse which explodes by the impact force generated on the collision with targets or ground, a chemical delayed self-destruct fuse causing self-destruct after a while by firing powder in the mechanical fuse, and an electronic delayed self-destruct fuse causing self-destruct after a while by the timer installed in the fuse.

When the shells employing mechanical fuses reach up to predetermined height, the powder inside the shell is exploded, and the shells are spread to the air by the explosion pressure, and fall down on the ground.

However, it sometimes occurs that the electronic delayed self-destruct fuse including the mechanical fuse is unexploded when the shell employing such electronic delayed self-destruct fuse falls on snow, water, barriers on the ground, inclined-surface ground, and so on because it lacks impact force. The electronic delayed self-destruct fuse is structured to be self-destruct in the secondary way in the case that the mechanical fuse does not work primarily by the reason as above. When the shell falls down on the ground and bounces, it is sometimes hit to the ground or stones thereby causing the electronic delayed self-destruct fuse broken off. As a result, the secondary self-destruct function does not work and the shell is remained as unexploded. Such unexploded shells bring the problems to affect fatal damages on civilians or own armies by accidental explosion as well as harmful influence on the firepower of own armies.

DISCLOSURE

Technical Problem

Therefore, the present invention has been made to solve the above problems, and it is an aspect of the present invention to provide a fuse having self-destruct function and impact resistance whereby a shell can be exploded even when the shell falls down but is unexploded and bounces, with grooves formed on the portion of the fuse slide in which a battery is displaced whereby the fuse slide can be broken off along the grooves upon the bounce of the shell and the fuse absorbs the impact applied to the entire fuse structure, and the battery is short and a control part controls the self-destruct directives by sensing the short of the battery.

Technical Solution

In accordance with the present invention, the above and other aspects can be accomplished by providing a fuse having self-destruct function and impact resistance provided in a shell and located beside a mechanical fuse, and functioning to ignite explosion of the shell in the case that the shell falls on the inclined ground or barriers but fails to be exploded by a mechanical fuse. The impact resistance self-destruct fuse may be formed with the configuration comprising a fuse slide having grooves provided on the top and the bottom at one side of the fuse slide, or on the right and the left sides so as to be easily breakable by absorbing the impact occurred when the shell falls and bounces, a battery provided inside the portion of the fuse slide which is separated off by the grooves, and a battery hit needle located along the line where the battery is located in order to hit the battery; an electric detonator igniting the explosion by the electric energy supplied from the battery or exploding the impact resistance self-destruct fuse by sensing the short of the battery in circuits; and a detonator located beside the electric detonator and exploding being hit by a hitting part.

Advantageous Effects

As described above, in accordance with the present invention, the fuse having self-destruct function and impact resistance provides effects of executing the self-destruct explosion of a shell which becomes unexploded occurs when the shell falls down and bounces off the ground without being exploded, by the structures in which grooves are formed on the portion of the fuse slide in which a battery is displaced whereby a portion of the fuse slide is broken off along the grooves upon the bounce of the shell and the fuse absorbs the impact applied to the entire fuse structure, and the battery becomes short and a control part senses the short of the battery and controls the self-destruct directives.

DESCRIPTION OF DRAWINGS

These and other aspects and advantages of the present invention will become apparent and more readily appreciated from the following description of the embodiments, taken in conjunction with the accompanying drawings, in which.

Figure 1:
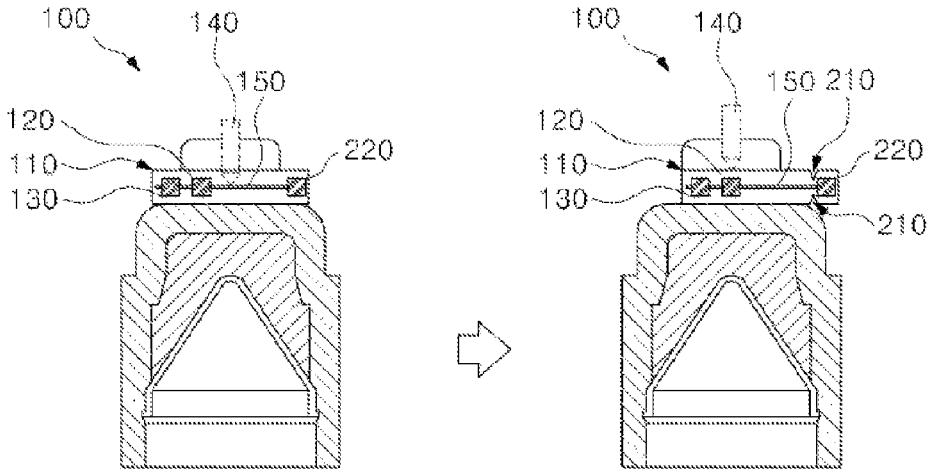
FIG. 1 is a sectional views showing a shell.

| [Brief description of reference numbers of major elements] | |
|---|---|
| 100: shell | 110: fuse slide |
| 120: detonator | 130: electric detonator |
| 140: hitting part | 150: electronic circuit |
| 210: grooves | 220: battery |
| 230: battery hit needle | 240: stopper |
| 241: protrusion | 250: safety pin |

BEST MODE

The present invention to achieve the above aspects has the characteristics as follows:

In accordance with an embodiment of the present invention, there is provided a fuse having self-destruct function and impact resistance provided in a shell (100) and located beside a mechanical fuse, and functioning to ignite explosion of the shell (100) in the case that the shell (100) falls on the inclined ground or barriers but fails to be exploded by a mechanical fuse, in which the impact resistance self-destruct fuse comprises a fuse slide (110) having grooves (210) provided on the top and the bottom at one side of the fuse slide (110), or on the right and the left sides so as to be easily breakable by absorbing the impact occurred when the shell falls and bounces, a battery (220) provided inside the portion of the fuse slide (110) which is separated off by the grooves (210), and a battery hit needle (230) located along the line where the battery (220) is located in order to hit the battery (220); an electric detonator (130) igniting the explosion by the electric energy supplied from the battery (220) or exploding the impact resistance self-destruct fuse by sensing the short of the battery (220) in circuits; and a detonator (120) located beside the electric detonator (130) and exploding being hit by a hitting part (140).

Mode for Invention

The present invention will now be described more fully hereinafter with reference to the accompanying drawings, in which preferred embodiments of the invention are shown.

It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the invention, based on the principle that an inventor may properly define the meaning of the words or terms to best explain the invention.

As used herein, the singular forms "a", "an" and "the" are intended to include the plural forms as well, unless the context clearly indicates otherwise.

The present invention may be embodied in different forms and should not be construed as limited to the embodiments set forth herein. Rather, these embodiments are provided as teaching examples of the invention. Therefore, it will be understood that the scope of the invention is intended to include various modifications and alternative arrangements within the capabilities of persons skilled in the art using presently known or future technologies and equivalents.

Figure 2:
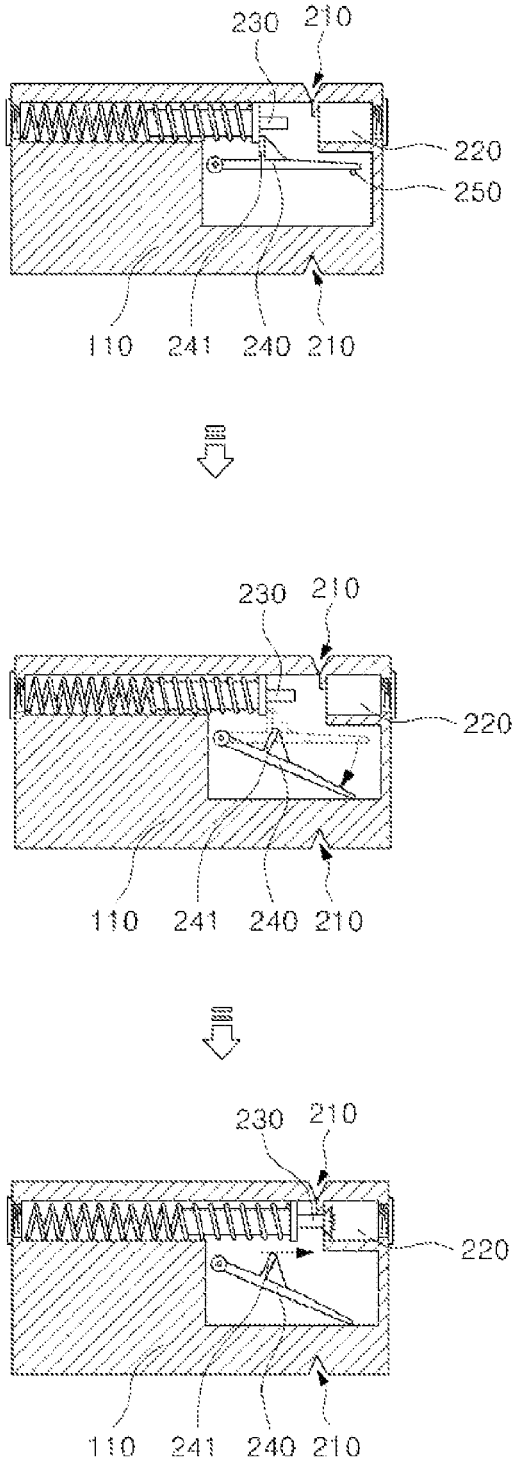
FIG. 2 is views showing that a shell operates according to one embodiment of the present invention.
Figure 3:
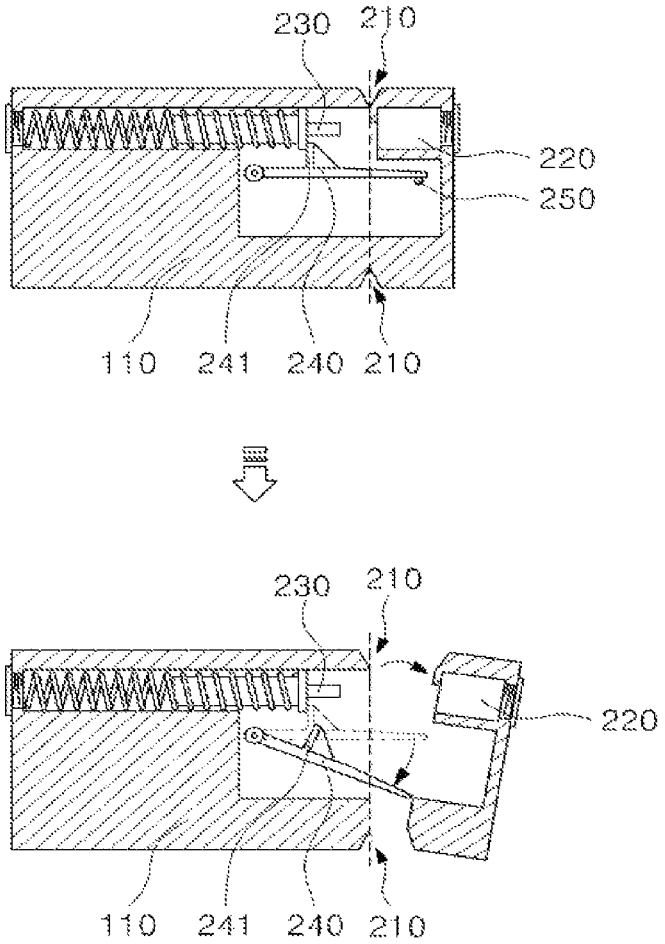
FIG. 3 is views showing that a fuse having self-destruct function and impact resistance operates according to one embodiment of the present invention.

FIG. 1 is a sectional views showing a shell, FIG. 2 is views showing that a shell operates according to one embodiment of the present invention, and FIG. 3 is views showing that a fuse having self-destruct function and impact resistance operates according to one embodiment of the present invention.

Hereinafter, referring to FIG. 1, a shell will be explained, referring to FIG. 2, the operation of a shell according to one embodiment of the present invention will be explained, and referring to FIG. 1, a fuse having self-destruct function and impact resistance according to one embodiment of the present invention will be explained.

As shown in FIG. 1, a shell (100) comprises a fuse slide (110), a detonator (120), an electric detonator (130), a hitting part (140), an electronic circuit (not shown), and a fuse hold hole (should be noted in FIG. 1). The shell (100) is structured to explode when the hitting part (140) hits the detonator (120).

When the self-destruct impact resistance fuse according to one embodiment of the present invention operates normally, the shell (100) explodes by making the hitting part (140) hit the detonator (120). In the case that the shell (100) does not explode for some abnormal operation reasons, the fuse slide 110 may be configured as shown in FIG. 2. That is, inside the fuse slide (110), there are provided a battery hit needle (230), a stopper (240), a safety pin (250), and a ribbon (not shown) connected to the safety pin (250) and exposed out of the fuse slide (110). In this configuration, the safety pin (250) is pulled out by the wind force, and the stopper (240), which holds the battery hit needle (230), is released. Then, the battery hit needle (230) hits the battery (220) so as to activate the battery (220). Electric energy is supplied from the activated battery (220) to the electronic circuit (150) so as to blow the electric detonator (130) after a while. Then, the electric detonator (130) blows the detonator (120) so as to explode the shell (100).

However, it may occur that the shell (100) is unexploded. When the shell (100) falls down on the ground, but does not explode, the shell (100) may bounce off the ground on impact with the ground. In the case that the protrusion part of the fuse slide (110) crashes the ground first by the bounce, the fuse slide (110) becomes short and its self-destruct function is lost.

In order to solve the problem as above, the present invention will be described with reference to FIG. 3. The fuse slide (110) comprises grooves (210) on the top and the bottom at its one side, or on the left and the right sides. When the shell (100) falls down on the ground, and the fuse slide (110) first impacts with the ground, the grooves (210) of the fuse slide (110) absorb the bounding impact which is generated by the impact of the fuse slide (110) with the ground. Thereby, it is prevented the entire fuse slide (110) from being broken while the portion only having the battery (220) is separated off. As above, in the case that the shell (100) is unexploded, and the grooves (210) of the fuse slide (110) is broken by the bounding impact, the battery (220) disposed inside the separated portion is short, and upon sensing of the short of the battery (220) by a control part (not shown), the electric detonator (130) bursts and the detonator (120) bursts by the electric detonator (130) so as to control and initiate the self-destruct function.

As explained above, it is structured such that the control part or a voltage detect circuit senses the short of the battery (220) and the self-destruct function is executed.

The battery (220) is disposed in the fuse slide (110), and located inside the portion of the fuse slide (110), which is separated off with the grooves (210) torn apart. While the battery (220) is activated by the battery hit needle (230) at normal operation, the battery (220) may be short with the fuse slide (110) torn apart and broken when the fuse slide (110) bounces after the shell is unexploded.

The shell (100) is exploded in that electric energy is supplied from the battery (220) to the electric detonator (130), and the hitting part (140) hits the detonator (120), or the electric detonator (130) bursts after a while and the detonator (120) located beside the electric detonator (130) bursts or the short of the battery (220) is sensed in circuits so as to explode the shell (100).

In the configuration of the fuse slide (110) as described above, the battery (220) becomes short from the fuse slide (110) by the grooves (210) of the fuse slide (110) when the explosion of the shell (100) fails. The short of the battery (220) is sensed by circuits, and the electric detonator (130) bursts, and the detonator (120) located beside the electric detonator (130) bursts. Therefore, the present invention provides effects of decreasing the unexplosion rate of the shell (100).

What is claimed is:

1. A fuse having self-destruct function and impact resistance provided in a shell (100) and located beside a mechanical fuse, and functioning to ignite explosion of the shell (100) in the case that the shell (100) falls on the inclined ground or barriers but fails to be exploded by a mechanical fuse, the impact resistance self-destruct fuse comprising:

a fuse slide (110) having grooves (210) provided on the top and the bottom at one side of the fuse slide (110), or on the right and the left sides so as to be easily breakable by absorbing the impact occurred when the shell falls and bounces, a battery (220) provided inside the portion of the fuse slide (110) which is separated off by the grooves (210), and a battery hit needle (230) located along the line where the battery (220) is located in order to hit the battery (220);

an electric detonator (130) igniting the explosion by the electric energy supplied from the battery (220) or exploding the impact resistance self-destruct fuse by sensing the short of the battery (220) in circuits; and a detonator (120) located beside the electric detonator (130) and exploding being hit by a hitting part.

2. The impact resistance self-destruct fuse according to claim 1, wherein the fuse slide (110) is broken off at the grooves (210) formed on the top and the bottom at one side of the fuse slide (110) or on the right and the left sides so that the impact, which is occurred when the shell (100) is unexploded and bounces, is not transferred to the detonator (120).

* * * * *